United States Patent [19]

Hertell

[11] 4,231,728

[45] Nov. 4, 1980

[54] ROTARY VANE PUMP

[75] Inventor: Siegfried Hertell, Radevormwald, Fed. Rep. of Germany

[73] Assignee: Barmag Barmer Maschinenfabrik Aktiengesellschaft, Remscheid-Lennep, Fed. Rep. of Germany

[21] Appl. No.: 886,545

[22] Filed: Mar. 14, 1978

[30] Foreign Application Priority Data

| | | | |
|---|---|---|---|
| Mar. 15, 1977 | [DE] | Fed. Rep. of Germany | 7707853 |
| Mar. 22, 1977 | [DE] | Fed. Rep. of Germany | 7708908 |
| Apr. 2, 1977 | [DE] | Fed. Rep. of Germany | 7710603 |

[51] Int. Cl.[3] ..... F04C 29/02

[52] U.S. Cl. ..... 418/79; 418/81; 418/82; 418/94

[58] Field of Search ..... 418/79, 81, 82, 93, 418/94

[56] References Cited

U.S. PATENT DOCUMENTS

| | | | |
|---|---|---|---|
| 2,324,903 | 7/1943 | Beckman | 418/93 X |
| 2,387,761 | 10/1945 | Kendrick | 418/82 |
| 2,801,791 | 8/1957 | Walter | 418/93 |
| 2,965,040 | 12/1960 | Eisenberg | 418/152 X |
| 3,289,651 | 12/1966 | Jinno | 418/94 X |
| 3,419,208 | 12/1968 | Brewer et al. | 418/152 X |
| 3,847,518 | 11/1974 | Prasse et al. | 418/152 X |

*Primary Examiner*—Leonard E. Smith
*Attorney, Agent, or Firm*—John H. Shurtleff

[57] ABSTRACT

An improved design for sealing and lubricating the moving parts of a rotary vane pump. An effectively operating lubricant distributing system is obtained in such a pump by forming radially extending passages through the pump drive shaft and attached rotor which connect the lubricant carrying hollow portion of the drive shaft with chambers located between the base of the vanes and the slits formed in the rotor in which the vanes radially slide. The rear bearing in which the drive shaft rotates is connected to these vane base chambers by means of an annular compartment having a lubricant duct connected thereto, thereby insuring the continuous flow of lubricant from the hollow portion of the drive shaft, through the vane base chambers and into the rear bearing. In an alternative embodiment of the present invention, the front bearing of the pump is connected with the hollow portion of the drive shaft via a lubricant passage formed on the suction side of the vanes. In addition, various designs of the above-mentioned front and rear bearing lubricant supply arrangements are also disclosed.

9 Claims, 3 Drawing Figures

ROTARY VANE PUMP

INTRODUCTION

The present invention relates generally to a rotary vane pump and, more particularly, to an improved design for sealing and lubricating the moving parts of such a pump.

BACKGROUND OF THE INVENTION

It is known that with rotary vane pumps, and particularly with those types used in motor vehicles, the required lubricant may be supplied via a hollow portion formed axially within the drive shaft of the device in order to seal the vanes of the pump along the internal walls of the stator housing and to lubricate all of the moving parts thereof. The lubricant, usually motor oil, is guided under pressure into the hollow portion of the pump drive shaft from a passage formed in the driving motor shaft.

Ball bearings are utilized in such known devices for positioning the pump drive shaft within the pump housing. Although these bearings are also lubricated by the lubricant fed to the pump, particular attention has not been paid to controlling the supply of the lubricant to them. Therefore, with these former designs it was possible for the bearings to revolve for varying periods in spent lubricant since its circulation was not controlled throughout the system. Hence, as a result of this fact the life span of the individual bearings was quite variable and often very short.

BRIEF DESCRIPTION OF THE INVENTION

The present invention eliminates the above-described lubrication problems found with conventional rotary vane pumps by providing a pump of improved design having an effectively operating lubricant distributing system. This object is achieved in its simplest form by forming radially extending passages through the drive shaft and attached rotor which connect the lubricant carrying hollow portion of the drive shaft with the chambers created between the base of the vanes and the slits formed in the rotor in which the vanes radially slide. The rear bearing in which the drive shaft rotates is connected to these vane base chambers by means of an annular compartment having a lubricant duct connected thereto thereby insuring the continuous flow of lubricant from the hollow portion of the drive shaft, through the vane base chambers and into the rear bearing.

Any suitable feed pipes such as passages, grooves, incisions and the like may be utilized as the above-mentioned lubricant duct. The term vane base chambers in the context of the present invention refer to the space formed between the underside of the vane and the base of the vane guide slit formed in the rotor.

The present invention permits the continuous flow of lubricant so as to supply the pump shaft bearings and the vane base chambers in which the vanes slide with fresh lubricant. The circulation of the lubricant to the bearings is aided by the centrifugal forces acting on the rotor and the displacement and suction effect of the vanes operating within the vane base chambers which take in and expel the lubricant. Due to this insured circulation effect, the life span of the bearings is substantially prolonged. Furthermore, the wear of the front faces of the vanes is reduced with the arrangement in that an axial force is caused to act on the rotor and vanes.

With the present design, it is not important whether only one of the pump bearings or both have such a lubricant cycle. However, in a particularly advantageous design of a lubricant cycle according to the present invention the rear bearing facing the machine side of the pump is provided with the above-described lubricant flow arrangement and the front bearing of the pump is connected with the hollow portion of the drive shaft via a lubricant passage formed on the suction side of the vanes. With this design each bearing has a separate lubricant supply thereby avoiding the complete collapse of the entire lubricant system if one lubricant flow supply fails to properly operate.

Another advantage found with the present invention is that it is possible to utilize sliding bearings on the pump drive shaft, i.e. such as a conventional friction bearing or sleeve bearing. Such bearings are much more desirable over ball bearings due to their mounting arrangement. However, with conventional pump designs it was not possible to use such sliding bearings, or only possible to use them to a restricted degree, since such bearings require an efficient lubricant cycle in order to operate properly.

With this embodiment of the invention, it is possible to encase both the front and rear drive shaft bearings with a sintered metal bushing. However, if the material used in the housing is aluminum, it is also possible to mount the pump drive shaft directly in this material thereby avoiding the necessity of providing an additional sintered metal bushing.

Another embodiment of the present invention provides an axially extending groove formed in the front bearing as the lubricant passage therein. This arrangement is particularly effective when a sliding bearing is utilized.

Furthermore, a radial groove connecting the front bearing to the vane base chambers which is offset with respect to the bottom dead center of the vanes and opposite the axially extending groove formed in the front bearing in the direction of rotation of the pump may be used particularly well in conjunction with a front sliding bearing of the sintered metal type. With such a design, a bezel is formed in either the front bearing itself or in the rotor in order to connect the radical groove with the axially extending groove formed in the front bearing. Such a design is advantageous with such bearings since the sintered metals used for the bearing material are able to store sufficient lubricant within their pore space thereby making periodic supply of lubricant quite adequate. In this manner, the amount of lubricant required by the pump may be reduced. In addition, the second supply source of lubricant to the vanes, which functions independently of the of the above-described passages supply source, makes it quite unlikely that such vanes will ever break down due to insufficient lubrication. In the context of this design, the point at which the vane has its lowest position, i.e., where it is completely withdrawn into the vane guide slit, is known as the bottom dead center.

In pump designs according to the present invention where the housing material is used as the sliding bearing material, the front bearing may be advantageously connected to the vane base chambers by means of an annular duct. Since the pump housing material is usually grey cast iron in such cases, a larger quantity of lubricant must be conveyed in and out of the bearing. The annularly formed duct of this embodiment insures such increased flow.

A ventilation passage connecting the annular compartment of the rear bearing to the outlet side of the pump may be advantageously used according to another embodiment of the present invention to deal with the unproblematical discharge of a larger quantity of lubricant.

It is further noted that embodiments of rotary vane pumps have been recently disclosed in which there exists an axial distance between the end of the hollow pump drive shaft and the driving motor shaft which is necessitated by the tolerances required in the means for fixing the pump to the machine component bearing it. This axial distance is bridged by an interconnecting dog member arranged integrally on the pump shaft and the motor shaft. With such pump designs, the flow of the lubricant between the hollow pump drive shaft and the motor shaft having the lubricating passage formed therein was interrupted. It is therefore a further object of this invention to maintain the above-described lubricant distributing systems in vane pumps having such axially displaced pump and motor drive shafts.

To this end a rigid feed pipe connecting to the lubricating passage formed in the motor shaft is extended axially into the hollow portion of the pump drive shaft. One of the advantages of this arrangement is that the lubricant is reliably conveyed into the hollow pump shaft even if it is highly viscous. Furthermore, errors in balance are prevented from acting on the feed pipe and issuing lubricant due to its central arrangement. In this manner, the centrifugal forces acting upon the feed pipe and issuing lubricant will be held to be very small.

By forming the outer diameter of the rigid feed pipe substantially smaller than the internal diameter of the hollow portion of the pump drive shaft, the outlet of the feed pipe acts as a nozzle so that the lubricant under pressure is able to issue as a jet thereby uniformly wetting the entire interior of the hollow pump shaft from which it is guided to the desired lubricating points in the pump by the above-described lubricant passages. A further advantage of this design is that the feed pipe will not be damaged when the pump is either dismantled or assembled (the feed pipe being fixed to the motor drive shaft) since there is no fitting arrangement between it and the hollow pump drive shaft.

Protection against unintentional leakage of the lubricant may be provided by forming the feed pipe with external threads on the end thereof which mate with corresponding threads formed in the lubricating passage of the motor shaft. Moreover, the dog member may be used to partially seal the pump on the drive side thereof by forming the outer diameter of the feed pipe substantially smaller than the internal diameter of the passage extending through the dog member.

In order to ensure that the vanes seal the pump chamber from the chamber coming into contact with lubricant under all operating conditions, according to another embodiment of the present invention, the vanes are made of polyimide or, in the case of extreme loads, polyimide reinforced with graphite and asbestos fibers. Such vanes have a high resistance to wear, high notched bar test toughness and high emergency running properties. In addition, due to the low weight of polyimide vanes as compared to steel, it is also possible to reduce the required performance of the drive motor. Another advantage of this material is that its thermal expension corresponds to that of the housing and rotor material and heating is very slight so that the desired seal effect therebetween is always maintained.

The invention and further advantages thereof will be described in more detail below with reference to the following drawings and selected embodiments thereof.

Figure 1:
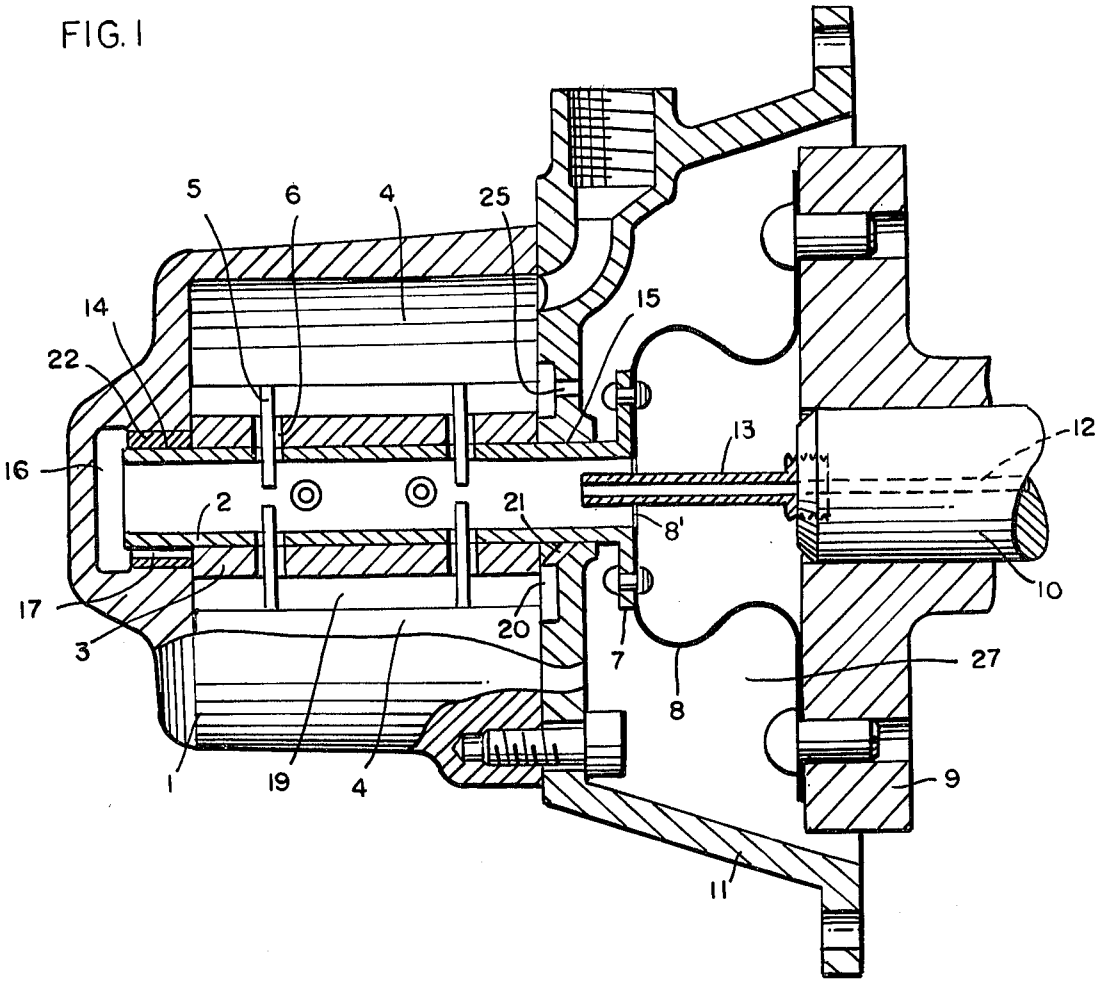
FIG. 1 is a side view in axial section of a rotary vane pump constructed in accordance with an embodiment of the present invention.

It is noted that in each of the above-described figures, the section was taken in such a manner that the two opposing visible vanes are equidistant from the rotational axis of the pump.

DESCRIPTION OF THE PREFERRED EMBODIMENT

Each of the drawings illustrates an embodiment of a rotary vane pump having lubricant distributing system constructed in accordance with the present invention. Pump drive shaft 2 is rotatably mounted in front and rear sliding bearings represented by the friction bearing surfaces 14 and 15 respectively of the pump stator housing 1. Pump shaft 2 rigidly supports rotor 3 and vanes 4 are arranged to move radially within slits formed in rotor 3. Each vane 4 has two pins 5 which are movable in passages 6 radially extending through the rotor and pump shaft. The opposing pins of the vanes are arranged at the same height. Thus, if a vane happens to jam within the rotor, the opposite vane will be able to push it out again as they rotate by means of pins 5.

Pump drive shaft 2 is designed as a hollow shaft having a flange 7 formed in the direction of its drive mechanism. A coupling member 8 is secured to flange 7 and the free end of coupling member 8 is fixed to drive plate 9 of a pump drive motor (not shown) having a shaft 10.

Coupling member 8 is positioned in a housing 11 which both supports the pump housing 1 and contains the inlet and outlet duct of the pump. Coupling member 8 is perforated 8' at the level of the pump shaft, i.e., the rear opening of the hollow shaft is not sealed off.

The lubricant is supplied under pressure through a lubricant pipe or passage 12 formed in the rotational axis of drive shaft 10 of the pump drive motor. The rigid feed pipe 13 is screwed or pressed into drive shaft 10 in its axial extension. At its other end, feed pipe 13 terminates within the hollow portion of pump drive shaft 2.

The front end of hollow pump drive shaft 2 terminates in a blocked space 16. An axial groove 17 extends from this space 16 through the front sliding bearing 14 which is formed by a sintered metal bushing 22.

The rear sliding bearing surface 15 is formed by the housing 11 which is constructed of aluminum or an aluminum alloy in this embodiment. A passage 21 which is inclined at an angle to the horizontal leads to this bearing. Several passages may be arranged about the rear bearing in this manner depending upon the material and size of the bearing. Passage 21 terminates in an annular space 20 which extends about rotor 3 to connect individual vane base chambers 19 at their rear ends.

Figure 2:
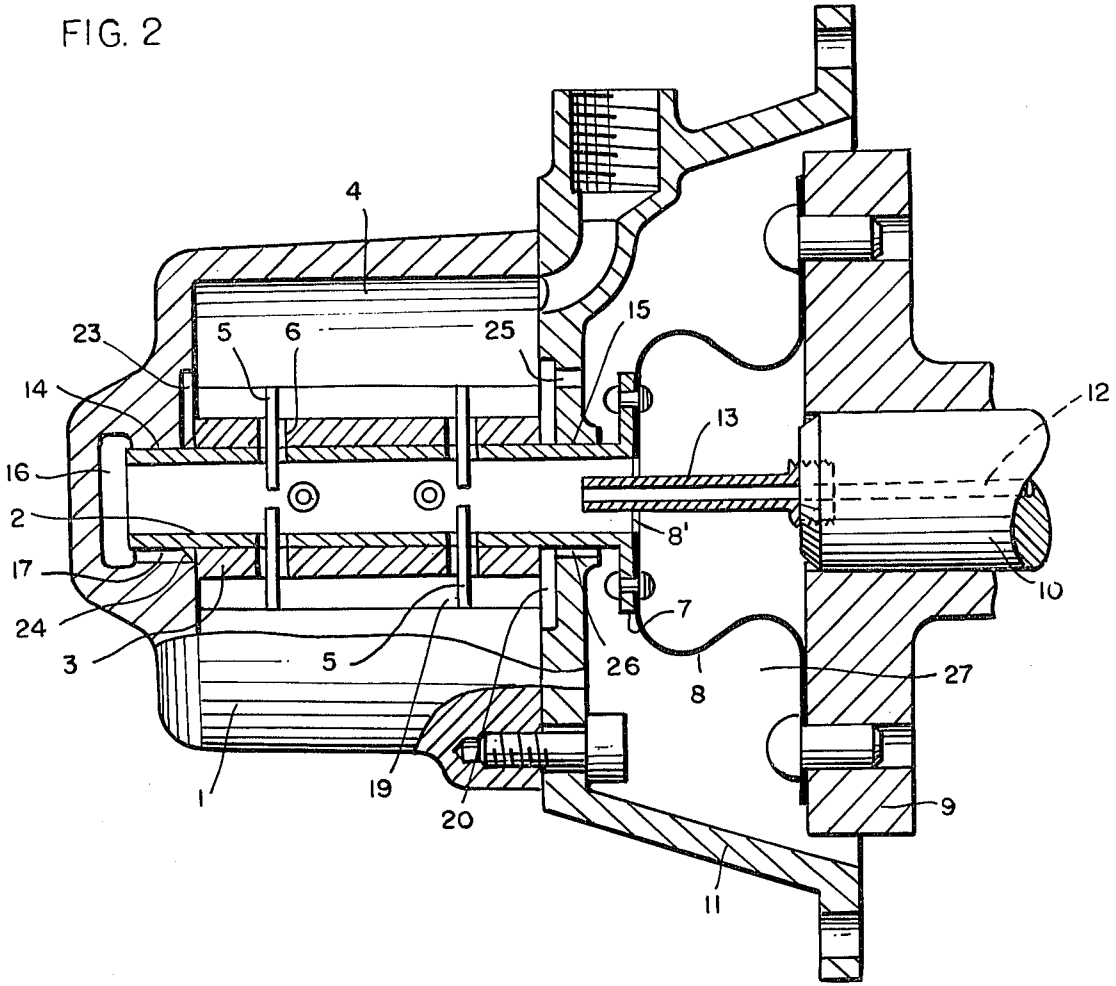
FIG. 2 is a side view in axial section of a rotary vane pump similar to that shown in FIG. 1 illustrating another embodiment of the present invention.

In this example, annular space 20 does not extend to the pump shaft 2 in order not to reduce the width of the bearing area. However, with suitable dimensioning of the bearing, it would be possible to extend annular space 20 to the pump shaft 2. In such a case, passage 21 may then be formed as an axial groove as is illustrated in FIG. 2.

The lubricant, usually a motor oil, is conveyed from the oil cycle of the vehicle motor through lubricant pipe 12 and feed pipe 13 into the pump shaft 2. Owing to the pressure of the oil, it will issue as a jet from the feed pipe and is squirted into blocked space 16. Due to the dynamic pressure of the oil and the lack of an outlet, it will be forced through groove 17 in the zone of the bearing which is released of pressure by the pump and onto the front bearing surface 14. In addition, aided by centrifugal force, the oil will also be forced through passages 6 into the vane base space 19. From vane base chamber 19, it is able to lubricate both the vane guides and the surfaces of the vanes which touch the inner wall of the stator housing 1. In addition, the oil is conveyed from vane base spaces 19 into annular space 20 from which it passes through passage 21 into bearing 15.

The supply of oil to the rear bearing surface 15 is aided by the entry and exit movement of the vanes within the rotor vane guides during the operation of the pump since the oil present in vane base chambers 19 will be displaced therefrom by the entry movement of the vanes into annular space 20 and thereby into passage 21. This displacement effect is dependent upon the diameter of passage 6 and upon the gap between the diameter of pins 5 and the internal wall of passage 6. In order to aid the supply of lubricant, a ventilation passage 25 may be formed as a connection between space 20 and the coupling space 27 of the pump.

The excess lubricant in hollow shaft 2 and blocked space 16 passes through the annular gap between feed pipe 13 and shaft 2 at the level of the flange and into coupling space 27 from which it may be recycled back into the oil sump of the vehicle motor by return pipes (not shown).

FIG. 2 illustrates the construction of a pump similar to that shown in FIG. 1. However, the arrangement of the front sliding bearing surface 14 is different in this design. In this embodiment, sintered metal bushing 22 which provided bearing surface 14 in FIG. 1 was not inserted into the housing. Pump housing 1 itself acts as the bearing surface in this embodiment. In the embodiment shown in FIG. 2, bearing surface 14 has a radial groove 23 connecting therewith in addition to axial groove 17. Groove 23 is arranged on the internal face of the pump housing at the point where the vanes begin their suction stroke. Since this point is not the same as the zone in which the bearing is relieved of pressure, these two grooves are offset with respect to each other. However, they are connected by a bezel 24 which is formed either on the bearing passage or in pump shaft 2.

The position of radial groove 23 has the advantage of allowing vanes 4 to take with them on their front faces the desired amount of lubricant during their exit movement from base chambers 19. In this manner, the sliding properties of the vanes are substantially improved.

Rear bearing surface 15 is also designed in a different manner in the embodiment shown in FIG. 2. Annular space 20 descends to the level of pump shaft 2 thereby allowing passage 21 of FIG. 1 to be formed as an axial groove 26. In order to increase the flow of the lubricant through the housing around the rear bearing surface 15, a ventilation passage 25 may also be added to connect annular compartment 20 with coupling compartment 27.

Figure 3:
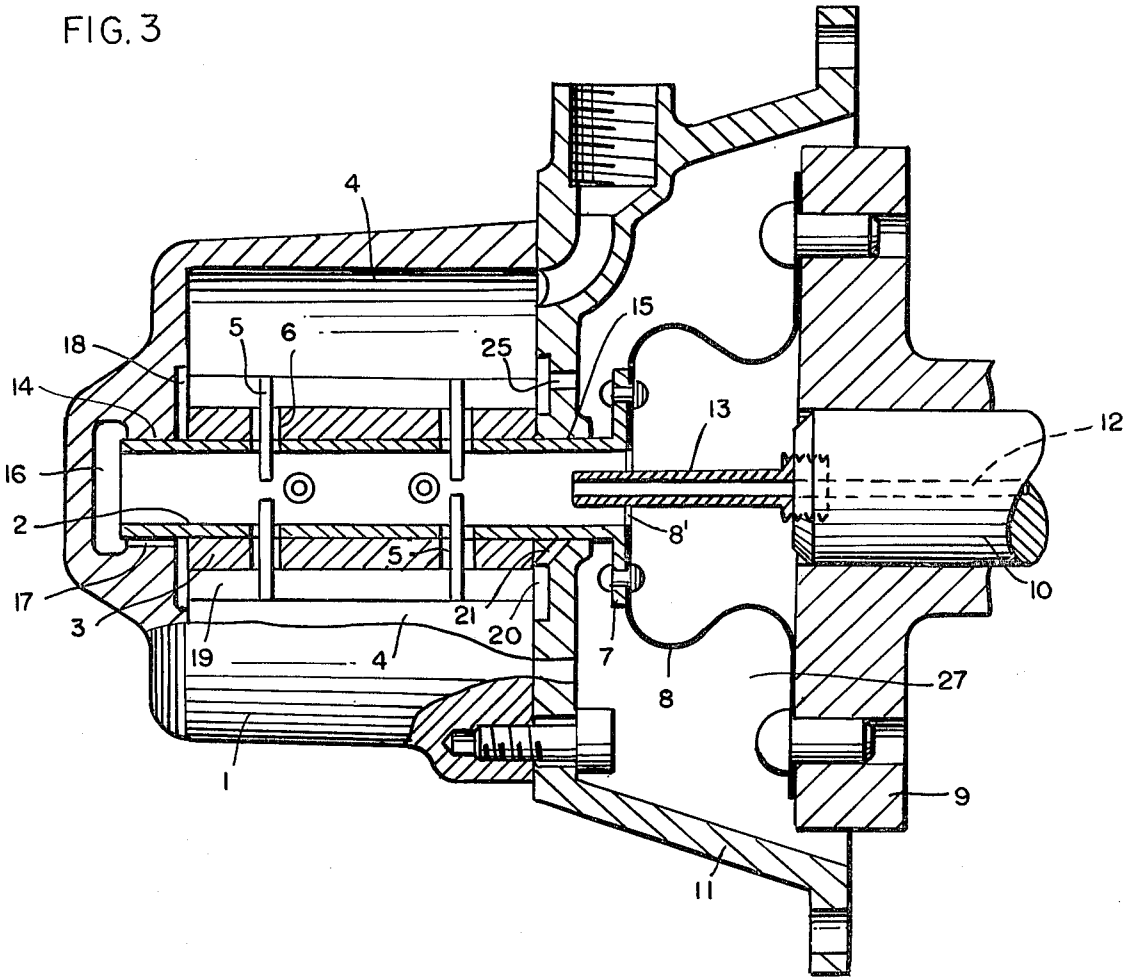
FIG. 3 is a side view in axial section of a rotary vane pump similar to those shown in FIGS. 1 and 2 illustrating another embodiment of the present invention.

In the embodiment shown in FIG. 3, both the front and rear bearing surface were modified from the above designs. Front bearing surface 14 is formed directly by housing 1 and has a radial, annular extending compartment 18 connecting therewith in contrast to the radial groove 23 of FIG. 2. Annular compartment 18 extends about housing 1 in such a manner that it joins axial groove 17 with the vane base chambers 19. With the design of this particular embodiment, a large amount of lubricant is able to flow into bearing 14 and the annular compartment 20 of bearing 15 in contrast to the embodiments shown in FIG. 1 and FIG. 2. This flow is further aided by ventilation passage 25 which joins with annular compartment 20 in this embodiment.

Since the pump design shown in FIG. 3 insures that sufficient fresh lubricant is fed to bearing surface 15, its use is particularly suitable when grey cast iron is used as the sliding bearing material in view of the fact that this material requires a higher throughput of lubricant.

While several particular embodiments of the present invention have been shown and described in detail, it should be understood that various obvious changes and modifications thereto may be made, and it is therefore intended in the following claims to include all such modifications and changes as may fall within the spirit and scope of this invention.

What is claimed is:

1. In a rotary vane pump of the type having a drive shaft rotating within front and rear bearings of which at least one is a sliding bearing, said drive shaft being connected to a rotor in which vanes are arranged to slide within radially formed slits, the vanes sliding with their ends projecting from the rotor along a stroke curve formed by the surrounding stator housing, said stroke curve encompassing at least one suction and pressure chamber which are arranged symmetrically to each other, and means to supply a lubricant to the elements of the pump through a hollow portion formed axially within the drive shaft, a support means for said stator housing enclosing a lubricant outlet side of the pump, and radially extending passages extending through the drive shaft and attached rotor, said passages connecting the hollow portion of said drive shaft with the chambers created between the base of the rotary vane and the slits formed in said rotor in which said vanes radially slide, the improvement comprising:

an annular compartment with a lubricant duct extension connecting the rear bearing surface in which said drive shaft rotates to said vane base chambers;

a ventilation passage connecting said annular compartment to the lubricant outlet side of said pump;

a lubricant passage formed on the suction side of said vanes by an axially extending groove which connects the front bearing surface on which said drive shaft rotates to the hollow portion of said drive shaft;

a radial groove connecting said front bearing to said vane base chambers, said radial groove being offset with respect to the bottom dead center of said vanes and opposite said axially extending groove in the direction of rotation of said pump; and a bezel formed in either said front bearing or rotor which connects with radial groove and axially extending groove.

2. The rotary vane pump of claim 1 wherein both said front and rear bearings are sliding bearings.

3. The rotary vane pump of claim 1 wherein said front bearing is a sintered metal bushing.

4. In the rotary vane pump of claim 1, the improvement further comprising:

an annular duct connecting said front bearing to said vane base chambers.

5. In the rotary vane pump of claim 1 wherein the hollow pump drive shaft is separated from the motor shaft having a lubricating passage formed therein and is driven by said motor shaft by means of an interconnecting coupling member, the improvement further comprising:

a rigid feed pipe in threaded connection with said lubricating passage formed in said motor shaft and extending axially into the hollow portion of said pump drive shaft, the outer diameter of the feed pipe extension being substantially smaller than the internal diameter of the hollow portion of said pump drive shaft.

6. In a rotary vane pump of the type having a drive shaft rotating within front and rear bearings of which at least one is a sliding bearing, said drive shaft being connected to a rotor in which vanes are arranged to slide within radially formed slits, the vanes sliding with their ends projecting from the rotor along a stroke curve formed by the surrounding stator housing, said stroke curve encompassing at least one suction and pressure chamber which are arranged symmetrically to each other, and means to supply a lubricant to the elements of the pump through a hollow portion formed axially within the drive shaft, a support means for said stator housing enclosing a lubricant outlet side of the pump, and radially extending passages extending through the drive shaft and attached rotor, said passages connecting the hollow portion of said drive shaft with the chambers created between the base of the rotary vanes and the slits formed in said rotor in which said vanes radially slide, the improvement comprising:

an annular compartment with a lubricant duct extension connecting the rear bearing surface in which said drive shaft rotates to said vane base chambers;

a ventilation passage connecting said annular compartment to the lubricant outlet side of said pump; and a rigid feed pipe connecting the lubricating passage formed in said motor shaft and extending axially into the hollow portion of said pump drive shaft, said feed pipe being interconnected with the axially space drive motor shaft by means of a flexible coupling member and the outer diameter of the feed pipe extension being substantially smaller than the internal diameter of the hollow portion of said pump drive shaft, thereby only partially sealing the pump on its drive shaft and forming a substantially pressureless lubricating oil feed system for the rotary vane pump.

7. The rotary vane pump of claim 6 wherein said vanes are made of a polyimide reinforced with graphite and asbestos fibers.

8. The rotary pump of claim 6 wherein both said front and rear bearings are sliding bearings.

9. The rotary pump of claim 6 wherein said front bearing is a sintered metal bushing.

* * * * *

UNITED STATES PATENT AND TRADEMARK OFFICE

CERTIFICATE OF CORRECTION

PATENT NO. : 4,231,728

DATED : November 4, 1980

INVENTOR(S) : Siegfried Hertell

It is certified that error appears in the above-identified patent and that said Letters Patent are hereby corrected as shown below:

In column 8, at line 16, change "feed pipe" to --pump drive shaft--;

In column 8, at line 17, change "space" to --spaced--.

Signed and Sealed this

*Nineteenth* Day of *May 1981*

[SEAL]

*Attest:*

RENE D. TEGTMEYER

*Attesting Officer*

*Acting Commissioner of Patents and Trademarks*